United States Patent [19]

Tachikawa et al.

[11] 4,363,957

[45] Dec. 14, 1982

[54] HEATING APPARATUS WITH CHAR DETECTING AND HEATING CONTROLLER

[75] Inventors: Hajime Tachikawa; Mitsuru Watanabe, both of Yokohama; Kenjiro Yokoyama, Yokosuka, all of Japan

[73] Assignee: Hitachi Heating Appliances Co., Ltd., Chiba, Japan

[21] Appl. No.: 99,929

[22] Filed: Dec. 3, 1979

[30] Foreign Application Priority Data

| | | | |
|---|---|---|---|
| Jan. 9, 1979 | [JP] | Japan | 54/1713 |
| Jan. 9, 1979 | [JP] | Japan | 54/1714 |
| Jan. 9, 1979 | [JP] | Japan | 54/1588[U] |
| Jan. 9, 1979 | [JP] | Japan | 54/1589[U] |

[51] Int. Cl.[3] ..... H05B 1/02

[52] U.S. Cl. ..... 219/497; 219/10.55 B; 219/10.55 F; 219/502; 219/506; 307/117; 374/161

[58] Field of Search ..... 219/506, 502, 497, 494, 219/10.55 B, 10.55 F, 121 LT, 508, 358; 73/356, 355 R, 244; 99/281; 307/117, 310

[56] References Cited

U.S. PATENT DOCUMENTS

| | | | |
|---|---|---|---|
| 3,887,781 | 6/1975 | Peters, Jr. | 73/355 R |
| 4,180,722 | 12/1979 | Clewans | 219/497 |
| 4,197,442 | 4/1980 | Carlsson et al. | 219/10.55 B |
| 4,213,023 | 7/1980 | Satoh et al. | 219/10.55 B |
| 4,238,672 | 12/1980 | Siess | 219/497 |
| 4,245,148 | 1/1981 | Gisske et al. | 219/502 |
| 4,262,183 | 4/1981 | Smith et al. | 219/10.55 B |

*Primary Examiner*—M. H. Paschall

*Attorney, Agent, or Firm*—Antonelli, Terry & Wands

[57] ABSTRACT

A heating apparatus capable of heating an article to be heated accommodated within a heating chamber to a degree that the article becomes charred. Illumination intensity of reflected light from the surface of the article illuminated with visible light rays from a light source is detected by an optical sensor, to thereby identify the degree of charring produced in the article, wherein heating operation is controlled on the basis of the identified degree of charring.

30 Claims, 11 Drawing Figures

HEATING APPARATUS WITH CHAR DETECTING AND HEATING CONTROLLER

BACKGROUND OF THE INVENTION

The present invention relates in general to a heating apparatus which incorporates a heat source interiorly or exteriorly of a heating chamber and is adapted to char an article to be heated or foodstuff to be cooked to a desired degree. In particular, the invention concerns a heating apparatus which is provided with a controller for performing a proper heating by automatically changing-over heating modes in dependence on the detected charring formed in an article to be heated such as foodstuff to be cooked.

In the field of heating apparatus or cooking apparatus such as electric oven, gas oven (or grill), oven range or the like in which an article to be heated or foodstuff to be cooked as accommodated within a heating chamber is subjected to hot air or infrared energy supplied from an electrical heater or gas burner, there has been a demand for charring the article to be heated or foodstuff to be cooked and controlling the degree of charring and hence the finished state of the processed article or foodstuff in a selectively set heating mode.

In hitherto known household cooking apparatus, the temperature of an article or foodstuff being processed is detected by means of a thermometer or alternatively by a bimetal strip to control an energy supply source when the temperature has attained a predetermined level. However, with the control system of this type, it has been impossible to control the degree of charring or superficial charring appearing at the surface of the article being heated. Consequently, the charring of the article or foodstuff being cooked in the conventional heating or cooking apparatus is visually observed to control the energy supply source or alternatively controlled by setting a heating time duration with the aid of a timer on the basis of prior experiences. It goes without saying that great difficulty is encountered in obtaining desired degrees of charring on various articles or foodstuff merely in dependence on the so-called sixth sense or experience.Obviously, the heating time duration for attaining a desired degree of charring will vary widely in dependence on various factors such as mass, water content, composition, shape and the like of the article or foodstuff. Thus, considerable skill is required for setting a proper heating duration for charring an article to a satisfactory degree. In reality, excessive heating or insufficient heating is frequently involved due to improper setting of the heating duration. Such being the circumstance, the user has to observe constantly the charred state of an article concerned, even when a timer for controlling the heating duration on the basis of experimentally obtained data is provided for the cooking apparatus. Thus, the user of the hitherto known heating or cooking apparatus is burdened with great inconvenience.

SUMMARY OF THE INVENTION

Accordingly, a main object of the invention is to provide a heating apparatus which avoids the disadvantages of the hitherto known apparatus such as described above and which is capable of automatically controlling the degree of charring in a desired manner.

In view of the above and other objects which will become apparent as description proceeds, it is proposed according to a general aspect of the invention that optical sensor means is provided exteriorly of the heating chamber or adjacent thereto, whereby the heating operation is automatically controlled in dependence on the measure of illumination intensity of light reflected from the surface of an article being heated.

Preferably, means is provided for protecting the optical sensor means from the heating operation.

Preferably, means are provided for maintaining the optical sensor in a clean state thereby to prevent the sensing performance of the optical sensor from being degraded.

The above and other objects, novel features and advantages of the invention will become more apparent from the description taken in conjunction with the accompanying drawings.

DETAILED DESCRIPTION OF THE PREFERRED EMBODIMENTS

Figure 1:
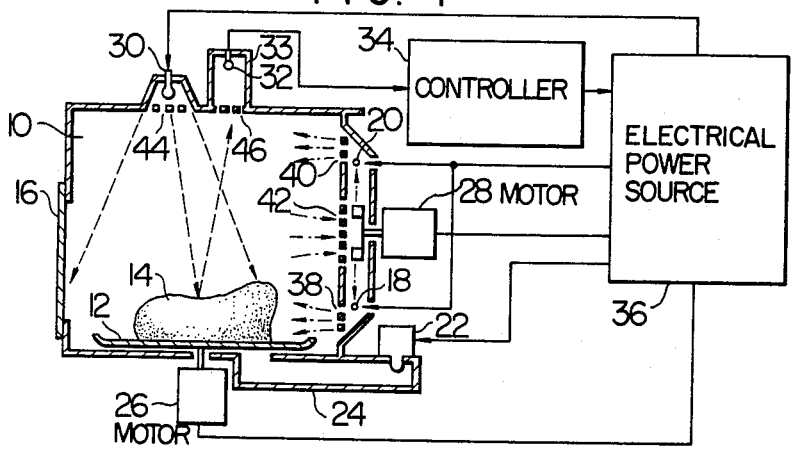
FIG. 1 shows schematically a general arrangement of a heating apparatus according to an embodiment of the invention.

FIG. 1 shows in sectional view an embodiment of an oven range of a hot-air circulating type according to the invention. By way of mere example, it is assumed that a heat source comprising electrical heaters and a high frequency energy generator is employed.

Referring to FIG. 1, reference numeral 10 denotes a heating chamber, 12 denotes a turntable made of a refractory material exhibiting a low dielectric loss when subjected to a high-frequency field, 14 denotes an article to be heated, 16 denotes a door, 18 and 20 designate electric heaters, 22 denotes a microwave oscillator tube such as a magnetron, 24 denotes a waveguide, 26 denotes an electric motor for driving the turntable 12, 28 denotes an illuminating lamp for emitting visible light rays, 32 denotes an optical sensor, 33 denotes a chamber for accommodating therein the optical sensor 32, 34 designates a controller, 36 denotes a power supply source, 38 and 40 denote hot-air inlet ports, 42 denotes a hot-air outlet port, and 44 and 46 designate perforations.

In operation, when an article 14 such as foodstuff to be heated or cooked is disposed on the turntable 12 and the door 16 is closed thereby to turn on the electric power supply source 36, the lamp 30 is lit to illuminate the article 14 to be heated. The light rays reflected from the foodstuff 14 will impinge on the optical sensor 32 from which an output signal is supplied to the controller 34. In this way, the sensed illumination intensity of the light reflected from the foodstuff 14 is stored or memorized in the controller 34. On the other hand, at the same time, operations of the electric heaters 18 and 20 as well as the fan 28 are initiated to blow the hot air into the heating chamber 10 through the inlet ports 38 and 40. The hot air is exhausted from the heating chamber 10 through the outlet port 42 to the electric heaters to be re-heated for circulation. The article of foodstuff 14 is heated under the action of the hot-air flow. Concurrently, the turntable is rotated by the drive motor 26 so that the foodstuff 14 disposed thereon is heated uniformly.

As the surface of the article of foodstuff 14 being heated gets charred, the illumination intensity detected by the optical sensor 32 will be correspondingly decreased. When the illumination intensity thus undergoing variation has attained a preset value or level, the controller 34 sends a signal to the power supply source 36 which then responds to the input signal to stop the operation of the electric heaters 18 and 20 as well as the fan 28 while initiating operation of the high-frequency oscillator tube or magnetron 22. The high-frequency energy generated by the oscillator tube 22 is introduced to the heating chamber 10 through the waveguide 24, whereby the article or foodstuff 14 is thus further heated under the action of the microwave energy. After elapse of a preset time duration, the energization of the oscillator tube 22, the electric motor 26 and the illuminating lamp 30 from the power supply source 36 is automatically stopped. At this time, the heating process for the article 14 has been completed. It should be mentioned that the size of the perforations or punched holes 46 should be of a size (cut off dimension) to prevent leakage of the microwave energy.

In FIG. 1, broken lines indicate optical paths of the illuminating rays, while dotted-broken line represents flows of the hot air.

Figure 2:
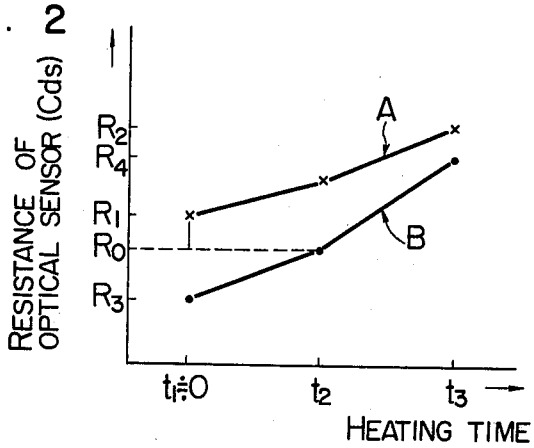
FIG. 2 illustrates variations in resistance value of a cadmium sulfide (CdS) photoconductive cell employed for the optical sensor in the apparatus shown in FIG. 1 as a function of the degree of charring for two kinds of articles to be processed.

In the following, consideration will be made on variations in resistance value of the optical sensor 32 during the heating process on the assumption that the optical sensor 32 is constituted by a CdS-photoelectric cell (hereinafter referred to as CdS-photosensor). Referring to FIG. 2 which illustrates graphically variations in the resistance value of the CdS-photosensor 32 as a function of heating time, it will be seen from a solid-line curve A that a resistance value $R_1$ of the CdS-photosensor 32 at a certain time point $t_1$ in the initial heating phase ($t_1 \approx 0$) is increased to a resistance value $R_2$ at a time point $t_3$ after elapse of a certain heating time because the article 14 to be heated becomes progressively charred to thereby lower correspondingly the illumination intensity at the surface of the article 14. In this connection, it is to be noted that the term "initial heating phase" is intended to means the period covering the heating process initiating time point (i.e. $t_1=0$) and a succeeding short time interval. Accordingly, it is possible to detect the instantaneous degree of charring on the basis of the variations in resistance of the CdS-photosensor 32 to thereby change the heating mode at a certain time point $t_2$ corresponding to a desired degree of charring, for example. The other solid-line curve B in FIG. 2 represents variations in resistance value of the CdS-photosensor 32 in the case where an article or foodstuff to be heated has an initial white surface as compared with the article or foodstuff to which the curve A is relevant. In this case, the resistance value $R_3$ at the time point $t_1$ in the initial heating phase is lower than the resistance value $R_1$ at the corresponding time point in the heating process to which the curve A is relevant. At the time point $t_3$, the resistance of the CdS-photosensor is increased only to a value $R_4$. As will be understood from the comparison of the curve A with B, the resistance value of the CdS-photosensor 32 at $t_1$ in the initial heating phase remains lever, as the initial color of the surface of the article to be heated is whiter. As the consequence, there may arise the case where the heating of the article under the action of hot air could not be performed when a reference value for changing the heating mode is merely set at a predetermined fixed value in the controller 34. For example, it is assumed that the reference value $R_0$ (FIG. 2). In the case of the article to which the curve B is relevant, the resistance of the CdS-photosensor 32 attains the reference value $R_0$ at the time point $t_2$, thereby changing the heating mode to stop the heating by hot air. In contrast, in the case of the article to which the curve A is relevant, the resistance value $R_1$ of the CdS-photosensor at $t_1$ in the initial heating phase is already higher than the present reference value $R_0$ by a magnitude indicated by an arrow in FIG. 2. Thus, the heating by hot air can not be carried out at all.

In order to evade the undesirable situation described above, it is proposed to store or memorize the resistance value of the CdS-photosensor 32 at $t_1$ in the initial heating phase for every heating process and control the heating mode in dependence on the increment in the resistance value (i.e. deviated value) with reference to the stored value. In other words, the inconvenience described above can be evaded by setting and storing a reference value which is higher than the resistance value of the CdS-photosensor 32 at $t_1$ in the initial heating phase by a predetermined magnitude and changing the heating mode when the actual resistance value of the CdS-photosensor 32 has attained the set reference value. In other words, the reference value is relatively set or determined in consideration of the resistance value of the CdS-photosensor 32 at $t_1$ in the initial heating phase. Additionally, correction is required for setting the reference value in dependence on the surface color of the article to be heated in view of the fact that the deviation in resistance value of the CdS-photosensor becomes larger, as the article is whiter in initial surface color. Detailed description of such correction will be made hereinafter.

Figure 3:
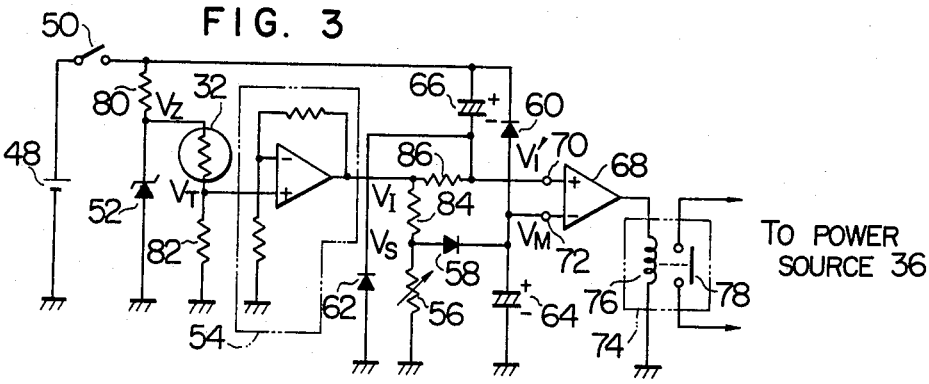
FIG. 3 is a schematic circuit diagram to show an embodiment of the control circuit according to the invention.

FIG. 3 shows an embodiment of the circuit arrangement of the controller 34 according to the present invention. In FIG. 3, reference numeral 32 denotes the CdS-photosensor for detecting the illumination intensity at an article 14 to be heated and hence the instantaneous degree of charring thereof. Numeral 48 denotes a d.c. power supply source 50, denotes a switch, 52 denotes a Zener diode, 54 denotes a non-inverting type d.c. amplifier, 56 denotes a variable resistor, 58 and 60 denote diodes, 64 and 66 denote capacitors, 68 denotes a comparator having a plus (positive) input terminal 70 and a minus (negative) input terminal 72, 74 denotes a relay having a coil 76 and a relay contact 78, and numerals 80, 82, 84 and 86 denote resistors, respectively. When the switch 50 is turned on, the constant-voltage circuit composed of the resistor 80 and the Zener diode 52 shifts the voltage supplied from the d.c. power supply source 48 to a constant voltage level and applies a constant voltage $V_Z$ across a series circuit of the CdS-photosensor 32 and the resistor 82. The series circuit of CdS-photosensor 32 and the resistor 82 serves as a voltage divider circuit for dividing the constant voltage $V_Z$ to produce a divided voltage $V_T$ which is applied to the input of the non-inverting amplifier 54. The voltage $V_T$ undergoes variations in dependence on the quantity of light impinging on to the CdS-photosensor 32 and thus provides a measure representing electrically the degree of charring of the article or foodstuff 14 being heated. It should be recalled that when the illumination intensity reflected from the surface of the article 14 is decreased as the article gets charred, the resistance value of the CdS-photosensor is increased to lower the signal voltage $V_T$. The non-converting type d.c. amplifier 54 amplifies the input voltage $V_T$ and produces an output voltage $V_I$ which will hereinafter be referred to as the char sensing voltage. The char sensing voltage $V_I$ is converted to a voltage $V_I'$ through a low-pass filter composed of the resistor 86 and the capacitor 66, which voltage $V_I'$ is applied to the plus input terminal 70 of the comparator 68. The voltage $V_I'$ will also be referred to as the char sensing voltage in the same sense as the voltage $V_I$. The char sensing voltage $V_I$ is additionally applied across a voltage divider circuit composed of the resistor 84 and the variable resistor 56 connected in series, whereby a divided voltage $V_S$ is derived and applied to the input of a capacitor memory circuit constituted by the diode 58 and the capacitor 64. The voltage across the capacitor 64 is applied to the minus or negative input terminal of the comparator 68. As will be described hereinafter, the voltage $V_S$ exhibits such behavior that it is increased to a peak level and then decreased. Thus, the voltage across the capacitor 64 behaves like the voltage $V_S$ so long as the voltage $V_S$ continues to increase. Under the circumstance where the voltage $V_S$ decreases, a voltage value approximately equal to the maximum value of the voltage $V_S$ is stored as a memory voltage $V_M$ in the capacitor 64 and supplied to the minus input terminal 72 of the comparator 68. The input voltage $V_T'$ is compared with the memory voltage $V_M$ by the comparator 68. If $V_I' > V_M$, the comparator 68 produces an output voltage of a high level. When $V_I' < V_M$, on the other hand, an output voltage of a low level is produced. The output voltage of the comparator 68 is fed to the coil 76 of the relay 74. In response to the high level output from the comparator 68, the relay contact 78 connected to the electric power supply source 36 is closed, whereby the heating of the article 14 such as foodstuff is performed by the flow of hot air in the manner described hereinbefore in conjunction with FIG. 1. When the relay contact 78 is opened, the hot-air heating is stopped and replaced by the high-frequency heating which is then continued for a preset duration. The diode 60 serves to discharge the capacitor 64, while the diode 62 serves to discharge the capacitor 66. In this connection, it is to be noted that the discharging time constants for these capacitors 64 and 66 are selected smaller than the respective charging time constants.

In operation of the oven range provided with the controller arrangement described above, an article 14 to be heated is disposed on the turntable 12, the door 16 is closed, and the switch 50 is closed. At this time point, since the capacitors 66 and 64 are in the short-circuited state in the sense of alternating current, the voltage across the capacitor 64 is very much lower than the charring sensing voltage $V_I'$ and therefore the high level output voltage is supplied from the comparator 68 to the coil 76 of the relay 74, whereby the relay contact 78 is closed. As the consequence, the power supply source 36 becomes operative to energize the illuminating lamp 30 as well as the fan 28, the electric heaters 18 and 20 and the electric motor 26 for driving the turntable 12. When the lamp is lit, the resistance value of the CdS-photosensor 32 is decreased, whereby the char sensing voltage $V_I$ is correspondingly increased. The increasing voltage $V_I$ will attain a peak level after elapse of about 10 seconds at the latest. When the surface of the article 14 begins to be charred, the illumination intensity reflected from the surface of the article is lowered, while the resistance value of the CdS-photosensor 32 is progressively increased. Consequently, the char sensing voltage $V_I$ is progressively lowered. On the other hand, the voltage $V_S$ is increased and the capacitor 64 is charged as the char sensing voltage $V_I$ is increased. However, upon decreasing of the voltage $V_I$, the voltage $V_S$ also begins to be lowered affer having attained its peak level. At this time point, the diode 58 takes the blocking state to be cut off, with the result that the voltage across the capacitor 68 corresponding to the peak level of the voltage $V_S$ is stored in the capacitor 68 as the memory voltage $V_M$. In this connection, it should be mentioned that the resistance values of the fixed resistors 86 and 84 and the variable resistor 56 are so selected that the magnitude of the memory voltage $V_M$ is smaller than that of the char sensing voltage $V_I'$ at the time when the voltage $V_S$ has attained the peak level. As the surface of the article 14 gets increasingly charred, the resistance value of the CdS-photosensor is correspondingly increased, whereby the char sensing voltage $V_I'$ will ultimately become lower than the memory voltage $V_M$. Then, the voltage supplied to the coil 76 of the relay 74 from the comparator 68 is changed over to the low level from the high level. Consequently, the contact 78 is opened, involving the changing-over in the heating mode from the hot-air heating to the microwave heating mode. After elapse of a preset time duration, the microwave heating operation is stopped with the lamp 30 and the motor 26 simultaneously deenergized to complete the heating process.

Figure 4:
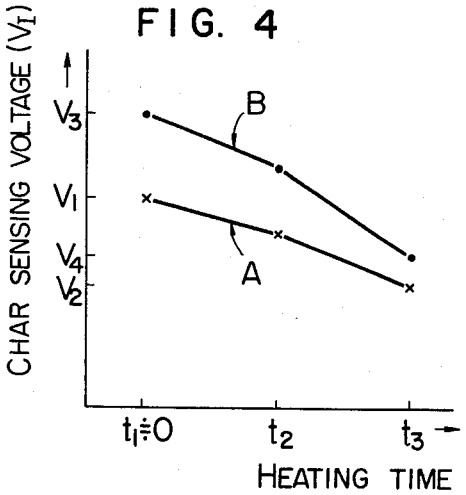
FIG. 4 graphically illustrates variations in a char detecting voltage $V_I$ produced in the control circuit shown in FIG. 3 for processing the articles relevant to the graphic illustration in FIG. 2.

FIG. 4 illustrates graphically the characteristic behaviors of the char sensing voltage $V_I$ by curves A and B in correspondence to the resistance variations of the CdS-photosensor 32 represented by the curves A and B in FIG. 2. Referring to FIG. 4, the char sensing voltage $V_I$ which is at a level $V_1$ (corresponding to the resistance value $R_1$ in FIG. 2) at a time point $t_1$ in the initial heating phase is decreased as a function of time to a voltage level $V_2$ (corresponding to the resistance value $R_2$ in FIG. 2) at a time point $t_3$, as is indicated by the solid line curve A. The solid line curve B in FIG. 4 represents the case in which the article to be heated has a whiter surface than the article to which the curve A is relevant. In this case, the char sensing voltage $V_I$ takes a high voltage level $V_3$ (corresponding to the resistance value $R_3$ in FIG. 2) already at the time point $t_1$ in the initial heating phase and is decreased as a function of time to a level $V_4$ (corresponding to the resistance value $R_4$ in FIG. 2) at the time point $t_3$.

Here, it should be recalled that the controller circuit is arranged such that the memory voltage $V_M$ which serves as the reference voltage level is set lower than the char sensing voltage $V_I'$ at $t_1$ in the initial heating phase (which is slightly lower than the voltage $V_I$). Thus, the teaching of the invention that as stated above a resistance value which is higher than the resistance value of the CdS-photosensor 32 at $t_1$ in the initial heating phase by a predetermined magnitude is established and stored as the reference value so that the heating mode may be changed over when the actual resistance value of the CdS-photosensor 32 has subsequently attained the stored reference level can be realized.

Next, the afore-mentioned correction of the preset reference value will be discussed. As can be seen from FIG. 4, the changing rate in the char sensing voltage (which of course corresponds to the changing rate in the resistance value of the CdS-photosensor) for the article represented by the curve B is greater than that for the article represented by the curve A. Accordingly, the difference between the char sensing voltage $V_I$ at $t_1$ in the initial heating phase and the memory voltage $V_M$ should not always be selected constant but be correctively varied in dependence on the initial surface colors of articles to be heated such that the voltage difference is relatively large for the article having an initial whiter surface as compared with thc article of an initial dark color. Otherwise, the changing-over of the heating mode would take place at a premature time point for the article having an initial white or bright surface as represented by the curve B, while the changing-over of the heating mode would be undesirably delayed for the article of an initial dark color as represented by the curve A. With a view to eliminating such inconveniences, it is proposed according to another aspect of the invention that correction be made in connection with the setting of the reference or memory voltage $V_M$. Such correction can be accomplished with the aid of the resistor 84 and the variable resistor 56. When the resistance values of the fixed resistor 84 and the variable resistor 56 are represented by R and VR, respectively, while the difference in the char sensing voltage at $t_1$ in the initial heating phase between two articles having different initial surface colors (i.e. $V_3-V_1$ in the case illustrated in FIG. 4) is represented by $\Delta V_I$ with the corresponding difference in the memory voltage represented by $\Delta V_M$, the following relationship exists between $\Delta V_I$ and $\Delta V_M$.

$$\Delta V_M = \frac{VR}{R + VR} \times \Delta V_I$$

Figure 5:
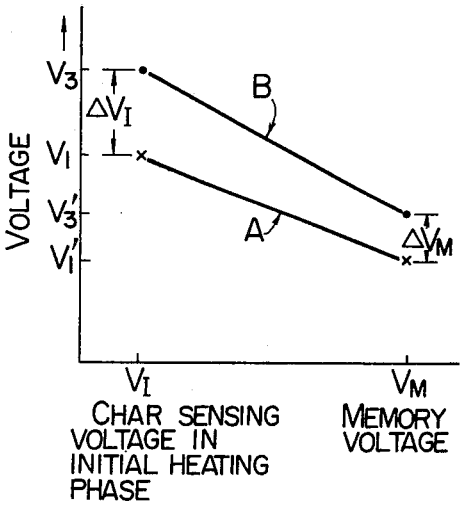
FIG. 5 graphically illustrates the relation between the char sensing voltage $V_I$ and a memorized reference voltage produced in the control circuit shown in FIG. 3 in correspondence to the graphs illustrated in FIG. 4.

By adjusting the variable resistor 56 so that $\Delta V_I > \Delta V_M$, the correction described above can be accomplished. FIG. 5 graphically illustrates how the correction is made. It will be seen that the difference $\Delta V_M$ in the memory voltage $V_M$ is set to be smaller than the difference $\Delta V_I$ in the char sensing voltage $V_I$ at $t_1$ in the initial heating phase. More specifically, correction is performed such that the difference between the char sensing voltage $V_I$ at $t_1$ in the initial heating phase and the memorized reference voltage $V_M$ becomes larger, as the char sensing voltage $V_I$ is higher at $t_1$ in the initial heating phase.

In the cas where the CdS-photosensor element is used as the optical sensor means, it has been experimentally found that the resistance value of the CdS-photosensor varies from about 900 Ω to about 1300 Ω in response to the charring of a satisfactory degree, which means that the charring can be detected with an adequately high accuracy.

Figure 6:
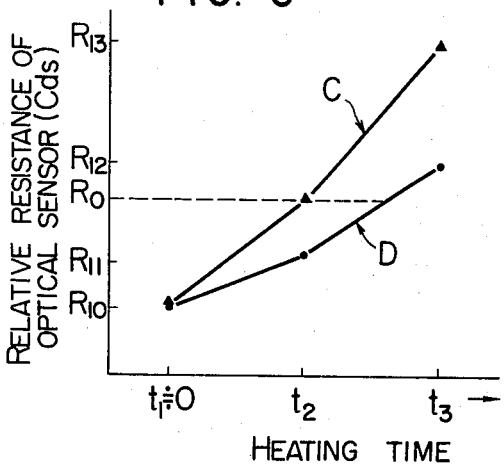
FIG. 6 graphically illustrates variations in sensitivity of a CdS-photosensor employed as the optical sensor in the heating apparatus shown in FIG. 1 in dependence on the sensing coverage area of the sensor for two different cases.
Figure 7:
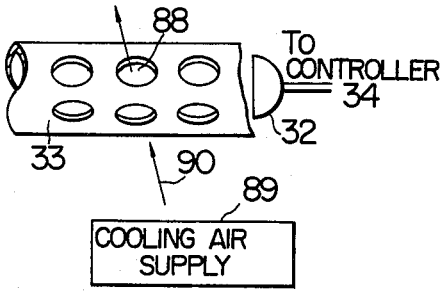
FIG. 7 shows in a schematical fragmental view an embodiment of a cooling arrangement for the optical sensor containing chamber.

Next, examination will be made on the sensing coverage or area of the optical sensor. FIG. 6 graphically illustrates variations in relative resistance value of the CdS-photosensor as a function of heating time with two different sensing coverages or areas used as parameters as represented by curves C and D. The curve C represents the variations in relative resistance value of the CdS-photosensor in the case where the sensing coverage of the CdS-photosensor is confined to the surface area of the turntable, while the curve D is depicted for the case where the sensing coverage of the CdS-photosensor is expanded for a larger area beyond the surface area of the turntable. Of course, the article 14 remains substantially same for both measurements. As can be seen from FIG. 6, the curve C has a steeper slope, which means that a higher sensitivity to the charring of the article being heated can be attained when the sensing coverage of the CdS-photosensor is confined to the surface area of the turntable. In the case where the CdS-photosensor is imparted with a larger sensing coverage than the surface area of the turntable, as represented by the curve C, radiation emitted by the illuminating lamp 30 as well as ambient light transmitting through a finder provided in the door 16 and reflected from the wall surfaces of the heating chamber 10 will constitute a relatively large proportion of light impinging on the CdS-photosensor, as a result of which contribution of the light rays reflected directly from the article being heated and impinging on the CdS-photosensor to the sensor output is correspondingly reduced. For this reason, the sensitivity of the CdS-phtosensor becomes degraded, as the sensing coverage area is enlarged. On the other hand, when the sensing coverage of the CdS-photosensor is restricted to an excessively small area, the charring state of the article being heated may be detected only for a part of the article, involving eventually non-uniform heating and charring. In the light of the foregoing analysis, the optimum sensing coverage of the CdS-photosensor is experimentally determined so that a satisfactory result as desired can be obtained. In general, it is preferred that the sensing or detecting coverage of the CdS-photosensor is selected to be equal to the top surface area of the turntable in consideration of the case where the load, i.e. the article to be heated is disposed over the whole surface of the turntable 12.

In the foregoing description, it has been assumed that the article to be heat-processed is disposed on the built-in turntable of the oven range. However, the article may be placed on a square dish, for example, disposed on a rack. In such case, the effective sensing coverage of the CdS-photosensor is determined so as to cover effectively the area of a supporting or recipient dish disposed at the lowermost position. Further, the lamp loding chamber 34 as well as the lamp 30 should be preferably disposed at a substantially center location of the ceiling of the heating chamber 10 so that the light rays reflected from the whole surface of the article being heated may be caught by the CdS-photosensor thereby to allow the charring state to be detected as a whole. The lamp 30 may better be positioned near to the door 16 in order to assure a convenient observation of the article within the heating chamber through the finder. It is self-explanatory that observation can be facilitated when much luminance is available in front of the article as viewed from the observer.

Now, description will be made of a structure of the chamber 33 for accommodating therein the optical sensor 32. The sensor lodging chamber 33 is composed of a pipe which is thermally insulated from the heating chamber 10 and the other high temperature locations and has a length selected so that the ambient temperature around the optical sensor 32 can be maintained at an adequately low level. The pipe 33 is provided with a plurality of through-holes 88 through which cooling air flows 90 are forcibly produced from a cooling air supply source 89 thereby to cool down the interior as well as the outer surface of the pipe 33. In this manner, the heat transmission to the optical sensor 32 can be prevented in a substantially satisfactory manner. It is of course possible without departing from the spirit of the invention to cool only the outer surface of the pipe 33 without resorting to the provision of the through-holes 88.

Figure 8:
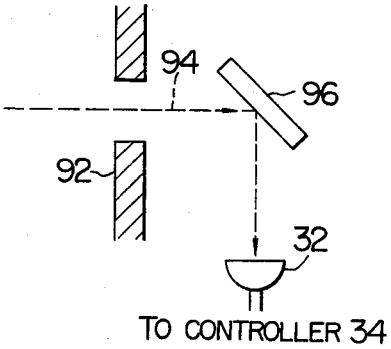
FIG. 8 shows in a schematic fragmental view an embodiment of an optical system for guiding the reflected light rays from the surface of an article being processed to the optical sensor.

FIG. 8 shows another embodiment for positioning and supporting the optical sensor 32. According to this embodiment, a refractor or reflector 96 is provided in opposition to an opening 92 formed in a wall of the heating chamber so that the light rays 94 reflected from the article 14 being heated is directed to the optical sensor 32 after deflection through the refractor or reflector 96. With such structure, it is possible to install the optical sensor 32 at any appropriate location where it will not be susceptible to the thermal influence from the heating chamber.

Figure 9:
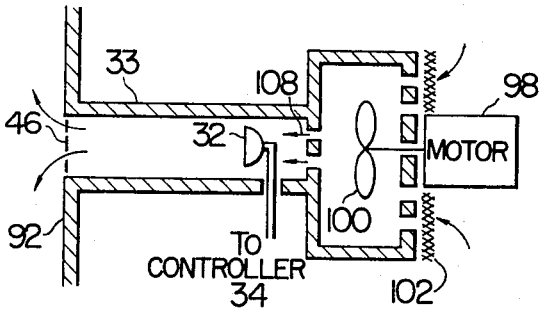
FIG. 9 shows in a fragmental sectional view another embodiment of a device for cooling the optical sensor containing chamber.

FIG. 9 shows another embodiment of the sensor lodging chamber 33. It will be noted that a fan 100 adapted to be driven by an electric motor 90 is provided at the rear side of the optical sensor 32. Numeral 102 represents a filter provided at the rear side of the fan 100. This filter 102 may be replaced by electrically conductive filters 106*a* and 106*b* disposed, respectively, before and behind the fan 100 and electrically connected to a battery 104, as is shown in FIG. 10.

Figure 10:
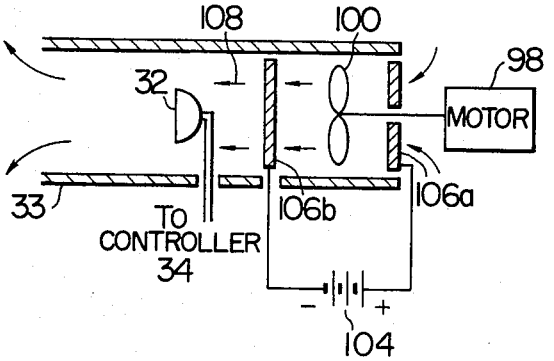
FIG. 10 is a fragmental sectional view showing the sensor cooling structure according to still another embodiment of the invention.

With the arrangements shown in FIGS. 9 and 10, intake air cleaning action is accomplished, wherein intake air is cleaned of dust or the like which is removed by the filter 102 or the filter combination 106*a;* 106*b* and introduced into the sensor lodging chamber 33 as a purified air flow. Further, in operation of the oven range, the pressure prevailing in the sensor lodging chamber 33 becomes higher than that of the heating chamber 10 by virtue of the forced air blowing, whereby the possibility of contaminated air in the heating chamber 10 invading the sensor lodging chamber 33 to contact the optical sensor 32 can be positively excluded. In this manner, the light receiving surface of the optical sensor 32 is maintained in a clean state to prevent the char sensing performance from being degraded for a long useful life of the oven range.

Figure 11:
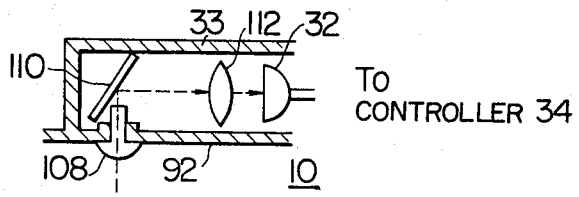
FIG. 11 is a schematic sectional view showing a structure for introducing the reflected light rays from an article being processed to the optical sensor, according to a further embodiment of the invention.

FIG. 11 shows a further embodiment of the sensor lodging chamber 33. In this figure, reference numeral 108 denotes a light collecting unit, 110 denotes a mirror and 112 denotes a lens for adjusting the sensing coverage of the optical sensor 32. The light collecting unit 108 serves not only to collect the light rays from the article 14 being processed but also to prevent hot air from intruding the sensor lodging chamber 33. With this structure, it is also possible to protect the desired characteristics of the optical sensor 32 from the influence of temperature in the heating chamber 10. Of course, a further improved performance can be accomplished by cooling additionally the optical sensor in an appropriate manner. It should be mentioned that the light collecting unit 108 should be of such a size that leakage of high-frequency energy from the heating chamber 10 can be suppressed. In the illustrated structure, the sensor lodging chamber 33 extends along a wall 92 of the heating chamber 10 to define the chamber 33 in cooperation with a portion of the wall 92. However, it will be readily understood that the sensor lodging chamber may be orientated in the manner shown in FIG. 1 or 9 with the mirror 110 being omitted.

Another factor to be considered in the char detecting control is the influence of the color of the turntable or recipient dish 12. When the turntable or recipient dish 12 white and the article disposed thereon is of a small size as compared with the surface area of the turntable or dish 12, the sensitivity of the optical sensor will be lowered for the reasons described in conjunction with FIG. 6. Further, the amplifier 54 of the controller circuit shown in FIG. 4 has to be imparted with a wider dynamic range, involving higher expense. Besides, excessively high illumination intensity as sensed by the optical sensor generally tends to shorten the useful life of the optical sensor. In view of these facts, the turntable or carrying dish should be preferably black in color.

With the arrangement according to the invention described in the foregoing, the optical sensor can be protected from thermal influences within the heating chamber, whereby the desirable characteristics of the optical sensor can be maintained constant for a long duration to allow desired charring to be produced in articles under automatic control.

Further, by virtue of such arrangement that the char sensing voltage in the initial heating phase is utilized as the reference voltage after having been corrected in dependence on the magnitude of the initial char sensing voltage and that when the instantaneous char sensing voltage or value corresponding thereto has attained the correctly set reference value, the changing-over of the heating mode takes place, the performance for detecting the charring van be prevented from being degraded even when the quantity of light emitted from the light source 30 is decreased due to the surface contamination thereof.

In the foregoing description, it has been assumed that the light source (i.e. illuminating lamp) is provided outside the heating chamber at a position adjacent thereto. However, it is should be self-evident that the invention is applied equally and is valid even when the light source is provided within the heating chamber at an appropriate location.

Further, in the case of the preferred embodiments described above, a single light source is employed in combination with a single optical sensor. However, it will be appreciated that the light source and/or optical sensor may be provided in plurality.

Although it has been assumed that a CdS-photosensor element is employed as the optical sensor, it will be readily understood that the invention can be equally carried out by using other types of optical sensors such as a photodiode, a photo-voltaic photodiode or the like in combination with a visible light correcting filter.

In the case of the preferred embodiments described above, it is assumed that the heating mode is changed from one to another when the char sensing signal available from the optical sensor has attained a preset level. However, the invention can be equally applied to the case where the heating operation is stopped or the degree of heating is varied.

It has been illustrated that the capacitor 64 is constituted by an electrolytic capacitor. It will however be appreciated that the invention can be carried out with other type of capacitor such as polyester film capacitor.

We claim:

1. In a heating apparatus provided with a heating chamber and heating means capable of heating an article accommodated within said heating chamber to such a degree as to produce charring, the improvement comprising:

light source means for illuminating a surface of said article accommodated within said heating chamber with visible light rays;

optical sensor means for sensing the illumination intensity reflected from the surface of said article;

means for actuating said heating means and said light source means to initiate a heating cycle;

means for detecting the output of said optical sensor means at an initial heating phase in every heating cycle subsequent to operation of said actuating means and for generating a reference value which is proportional thereto;

memory means for storing said reference value;

comparing means for comparing the content of said memory means with the output of said optical sensor means which varies with time as the heating proceeds; and control means for controlling the heating operation of said heating means in response to an output signal from said comparing means.

2. A heating apparatus according to claim 1, wherein said control means comprises means responsive to said comparing means for changing the heating operation of said heating means when the output from said optical sensor means has attained a predetermined value.

3. A heating apparatus according to claim 2, wherein said predetermined value is determined in dependence on the specific value of said time-varying output of said optical sensor means stored in said memory means during the initial heating phase of the heating cycle.

4. A heating apparatus according to claim 2, wherein said heating operation control means includes correcting means for correcting said predetermined value in dependence on the specific value of said time-varying output stored in said memory means during the initial heating phase and means setting the corrected value as a reference value for said comparing means.

5. A heating apparatus according to claim 4, wherein said correcting means is arranged such that, when two different articles are heated during respective heating cycles, the difference between two specific values of said time-varying output in the respective initial heating phases of the respective heating cycles becomes smaller than the difference between two reference values preset in dependence on said two specific values, respectively.

6. A heating apparatus according to claim 2, 3, 4 or 5, wherein said heating means comprises a first heater and a second heater, and wherein said means for changing the heating operation comprises switching means for changing a first heating mode effected by said first heater to a second heating mode effected by said second heater.

7. A heating apparatus according to claim 6, wherein said control means includes further means for stopping said second heating mode after elapse of a predetermined time duration subsequent to the changing-over of said heating mode by said switching means.

8. A heating apparatus according to claim 2, 3, 4 or 5 wherein said means for changing the heating operation comprises means for stopping the heating operation.

9. A heating apparatus according to claim 2, 3, 4 or 5, wherein said means for changing the heating operation comprises means for varying the degree of heating.

10. A heating apparatus according to claim 1, wherein said optical sensor means is so disposed that the sensing coverage of said sensor means is substantially confined to a surface area of a supporting member for receiving thereon said article accommodated within said heating chamber.

11. A heating apparatus according to claim 1, wherein said optical sensor means includes an optical sensor disposed outside said heating chamber and means for guiding light rays reflected from the surface of said article accommodated within said heating chamber to said optical sensor.

12. A heating apparatus according to claim 11, wherein said reflected light guiding means includes aperture means provided in a wall of said heating chamber, said reflected light rays passing outwardly from said heating chamber through said aperture means and being introduced to said optical sensor along an optical path.

13. A heating apparatus according to claim 12, wherein said reflection light guiding means includes light collecting means adapted to thermally block said aperture means while permitting light rays to be transmitted through said aperture means, said reflected light rays being introduced to said optical sensor through said light collecting means.

14. A heating apparatus according to claim 13, wherein said reflected light guiding means includes lens means disposed on said optical path and serving to adjust the sensing coverage of said optical sensor.

15. A heating apparatus according to claim 12, 13 or 14, wherein said reflected light guiding means includes reflecting means disposed on said optical path, said reflected light rays being additionally reflected by said reflecting means and thereafter introduced to said optical sensor along said optical path.

16. A heating apparatus according to claim 15, wherein said reflected light guiding means includes a containing chamber for containing therein said optical sensor, said containing chamber being disposed adjacent to said heating chamber at a position where said optical path extends through the interior of said containing chamber, and further includes protection means for preventing the temperature within said sensor containing chamber from rising under the influence of the temperature prevailing within said heating chamber.

17. A heating apparatus according to claim 16, wherein said protection means includes means for cooling said sensor containing chamber.

18. A heating apparatus according to claim 17, wherein said cooling means includes a plurality of cooling air passage holes formed in a wall portion defining said sensor containing chamber and means for causing said cooling air to flow into said sensor containing chamber through said cooling air passage holes.

19. A heating apparatus according to claim 16, wherein said protection means includes means for increasing pressure in said sensor containing chamber higher than pressure prevailing within said heating chamber.

20. A heating apparatus according to claim 3, wherein said optical sensor means includes photoelectric control means, said heating control means including first electric circuit means provided in association with said photoelectric control means and adapted to produce said time-varying output in the form of a voltage, second electric circuit means comprising said memory means for storing said specific value in the form of a voltage in response to the output of said first electric circuit means and adapted to output the stored value from said memory means, and said comparing means comprising a comparator circuit for comparing outputs from said first and second electric circuit means with each other.

21. A heating apparatus according to claim 20, wherein said photoelectric control means includes a photoconductive cell, said first electric circuit means being adapted to produce said time-varying output in the form of voltage in response to variation in electric resistance of said photoconductive cell caused by variation in the intensity of said reflected light.

22. A heating apparatus according to claim 20, wherein said actuating means includes a normally opened contact adapted to be closed in the initial heating phase, and wherein said first electric circuit means includes an electric potential source, first voltage divider means containing said optical sensor means as a part thereof and having a first tap, said first voltage divider means being connected to said electric potential source through said normally opened contact and adapted to divide the potential provided by said electric potential source upon closing of said normally opened contact thereby producing at said first tap a potential undergoing variation in dependence on the electrical state of said optical sensor means, second voltage divider means having a second tap, a first capacitor connected between said second voltage divider means and said electric potential source through said normally opened contact so as to be charged through said second voltage divider means upon closing of said normally opened contact, and means for transmitting the potential appearing at said first tap to a junction between said first capacitor and said second voltage divider means;

wherein said second electric circuit means includes a second capacitor, and a blocking diode connecting between said second tap and said second capacitor so as to transmit the potential appearing at said second tap to said second capacitor for charging said second capacitor; and wherein said comparator circuit has a first and a second input terminal, said first input terminal being connected to said junction between said first capacitor and said second voltage divider means, while said second input terminal is connected to a junction between said second capacitor and said blocking diode.

23. A heating apparatus according to claim 22, wherein said second voltage divider means includes a fixed resistance portion and a variable resistance portion, an end of said fixed resistance portion and an end of said variable resistance portion are connected together to constitute said second tap, the other end of said fixed resistance portion is connected to said first capacitor.

24. In a heating apparatus provided with a heating chamber and heating means capable of heating an article accommodated within said heating chamber to such a degree as to produce charring, the improvement comprising:

light source means for illuminating a surface of said article accommodated within said heating chamber with visible light rays;

optical sensor means for sensing the illumination intensity reflected from the sensor of said article and for producing an output signal representative thereof;

means for actuating said heating means and said light source means to initiate a heating cycle;

means for detecting the output signal of said optical sensor means immediately after operation of said actuating means and for generating a reference signal which is proportional thereto;

comparing means for comparing the output of said optical sensor means to said reference signal; and control means for controlling said heating means in response to the output of said comparing means.

25. A heating apparatus according to claim 24, wherein said means for detecting the output signal of said optical sensor means and for generating a reference signal includes means for producing a voltage which is in a preselected proportion to the output of said optical sensor means upon initiation of a heating cycle and memory means for storing said voltage as said reference signal.

26. A heating apparatus according to claim 25, wherein said voltage producing means comprises a variable voltage divider connected to receive the output of said optical sensor means, a tap of said voltage divider being connected to said memory means to supply said voltage thereto which represents said reference signal.

27. A heating apparatus according to claim 25, wherein said voltage producing means is connected to said memory means by way of diode means for supplying to said memory means the maximum voltage produced by said voltage producing means during a given heating cycle.

28. A heating apparatus according to claims 26 or 27, wherein said memory means comprises a capacitor.

29. A heating apparatus according to claim 24, wherein said control means comprises means responsive to said comparing means for changing the heating operation of said heating means when the output from said optical sensor means has attained a predetermined value.

30. A heating apparatus according to claim 29, wherein said heating means comprises a first heater and a second heater, and wherein said means for changing the heating operation comprises switching means for changing a first heating mode effected by said first heater to a second heating mode effected by said second heater.

* * * * *